US007347662B2

(12) United States Patent
Balsdon

(10) Patent No.: US 7,347,662 B2
(45) Date of Patent: Mar. 25, 2008

(54) SEALING ARRANGEMENT

(75) Inventor: Julian Glyn Balsdon, Bristol (GB)

(73) Assignee: Rolls-Royce plc, London (GB)

( * ) Notice: Subject to any disclaimer, the term of this patent is extended or adjusted under 35 U.S.C. 154(b) by 261 days.

(21) Appl. No.: 11/240,765

(22) Filed: Oct. 3, 2005

(65) Prior Publication Data

US 2006/0078421 A1 Apr. 13, 2006

(30) Foreign Application Priority Data

Oct. 11, 2004 (GB) ..... 0422505.8

(51) Int. Cl.
*F01D 11/00* (2006.01)

(52) U.S. Cl. ..... 415/174.2

(58) Field of Classification Search ..... 415/173.7, 415/174.2, 174.3, 170.1
See application file for complete search history.

(56) References Cited

U.S. PATENT DOCUMENTS 5,738,490 A 4/1998 Pizzi
6,076,835 A 6/2000 Ress et al.

FOREIGN PATENT DOCUMENTS

EP 1 245 790 A1 10/2002
GB 2 102 897 A 2/1983

*Primary Examiner*—Edward K. Look
*Assistant Examiner*—Dwayne J White
(74) *Attorney, Agent, or Firm*—Oliff & Berridge, PLC

(57) ABSTRACT

A sealing arrangement between annular components 2, 4, for example in a gas turbine engine, comprises an L-shaped sealing ring 20. The sealing ring 20 has a first limb 24 received in a groove 28 in the first component 2, and a second limb 26 having a sealing face 30 which is maintained in contact with an abutment surface 32 on the second component 4 under the resilient action of the sealing ring 20. The second limb 26 is exposed to the pressure in a chamber 34 which assists the resilience of the sealing ring 20 in maintaining sealing contact between the sealing face 30 and the abutment surface 32. Bleed holes 38 are provided.

11 Claims, 1 Drawing Sheet

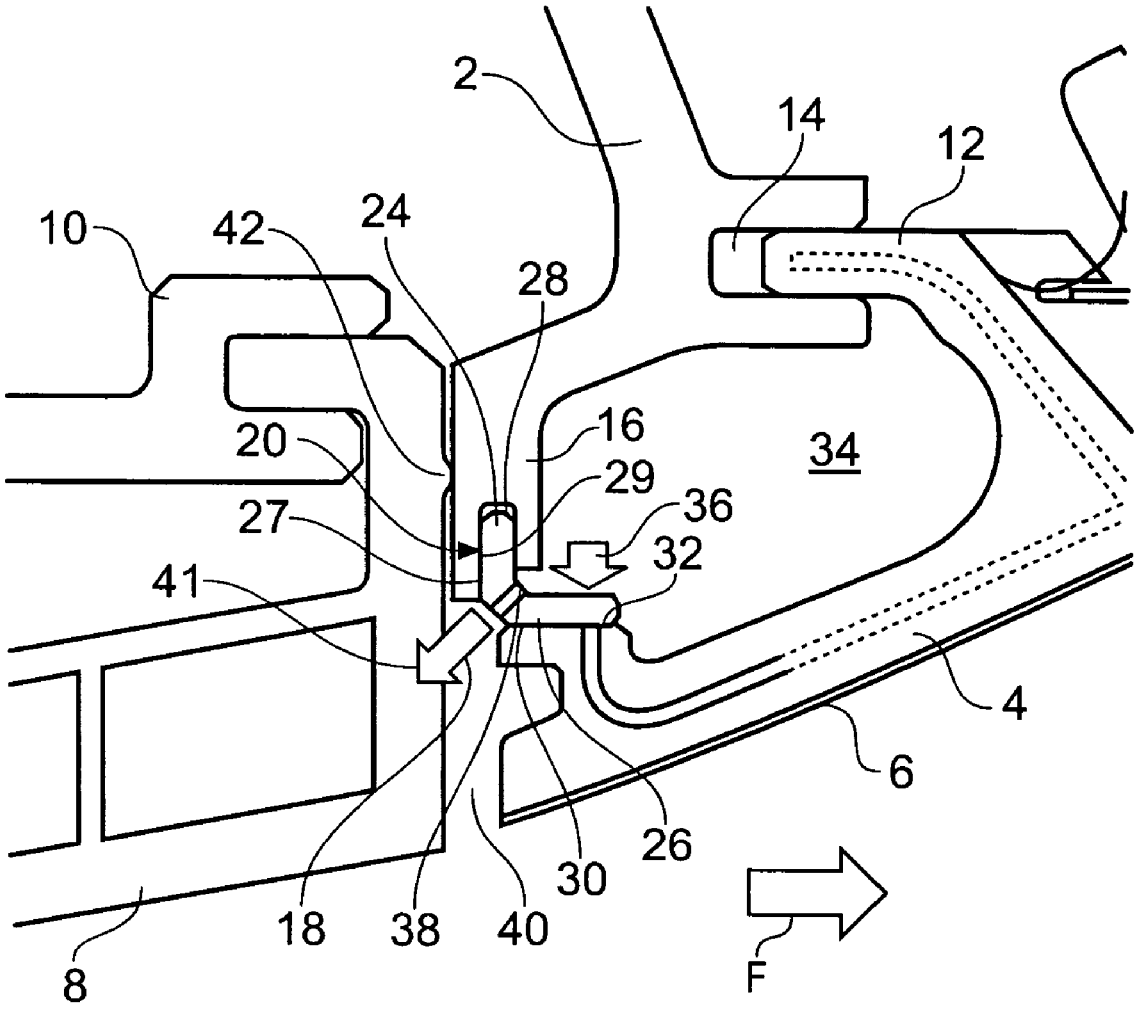
2
14
12
10
42
24
28
16
34
20
29
36
27
32
41
4
6
26
30
18
38
40
8
F

SEALING ARRANGEMENT

This invention relates to a sealing arrangement between first and second annular components, and is particularly, although not exclusively, concerned with such a sealing arrangement for use in a gas turbine engine.

The structure surrounding the turbine stages of a gas turbine engine is subjected to significant temperature fluctuations during the operating cycle of the engine. Consequently, components of the structure may move relatively to one another, and this movement may cause difficulties if a seal is to be maintained between two components. To achieve sealing, it is known to provide a "piston ring" type of sealing ring which comprises a split, radially resilient ring accommodated in a groove in one of the components, the ring being radially biased by its own resilience into contact with an abutment surface of the other component.

It is often the case that the resilience of the material of the ring is insufficient to achieve an adequate contact pressure with the abutment surface, and so a "cockle" spring may be provided within the groove to provide an additional force biasing the sealing ring into contact with the abutment surface. A cockle spring is a ring of resilient material, such as spring steel, which has an undulating form in the circumferential direction.

A problem with sealing arrangements of the piston ring type is that a spring steel cockle spring is unable to withstand the temperatures that occur in the turbine stage of a gas turbine engine. The sealing ring alone, especially if made from a material which will withstand these temperatures, has insufficient resilience to generate an adequate contact force at the sealing faces. Furthermore, it is sometimes desirable for a controlled bleed of cooling air to be allowed across the seal in order to cool the components of the sealing arrangement, and it is difficult to provide holes for this purpose in a piston ring type of seal.

Another form of seal between components of the structure surrounding the turbine stage of a gas turbine engine is disclosed in EP-A-1245790. This document discloses a sealing arrangement between first and second annular components having a common axis, the arrangement comprising a sealing ring which, as viewed in cross-section, has a first limb which is slidable within a circumferential groove provided in the first annular component, and a second limb which is inclined to the first limb and which makes sealing contact with the second component. The second component also has a groove within which the second limb is accommodated. The two limbs are at right angles to each other, so that relative axial displacement between the components is accommodated by displacement of one of the limbs in one of the grooves, and relative radial displacement is accommodated by displacement of the other limb in the other groove. However, the sealing ring shown in EP-A-1245790 is not radially resilient because it is continuous around its circumference, and consequently the sealing arrangement is subject to differential thermal expansion effects arising between the components and the sealing ring.

According to the present invention, the sealing ring is radially resilient, the second limb having a sealing face which is biased by the resilience of the sealing ring into contact with an abutment surface of the second component.

The sealing ring may be a split ring, having an interruption at a single position around its circumference, so as to provide its radial resilience. In a preferred embodiment, the first and second limbs are perpendicular to each other, the first limb extending radially with respect to the axis, and the second limb extending parallel to the axis. The sealing face may be disposed on the side of the second limb opposite the first limb. The first limb may be directed away from the axis, so that the sealing ring is an "in-springing" ring with the sealing face biased radially inwardly into contact with the abutment face.

The sealing ring may have bleed holes permitting controlled flow across the sealing ring, for example to cool the sealing ring. The bleed holes may be disposed at the junction between the first and second limbs of the sealing ring.

A sealing arrangement in accordance with the present invention has particular application to gas turbine engines, and so the first and second annular components may be, for example, components of a turbine casing of a gas turbine engine. When in use in a gas turbine engine, the sealing ring may serve to separate regions of high and low pressure air within the engine, and the sealing ring may be disposed so that the pressure in the high pressure region acts on the second limb to assist the resilience of the sealing ring in pressing the sealing face into contact with the abutment surface.

If bleed holes are provided, they are preferably positioned to enable flow across the sealing ring from the high pressure to the low pressure region.

The present invention also provides a gas turbine engine including a sealing arrangement as defined above.

For a better understanding of the present invention, and to show more clearly how it may be carried into effect, reference will now be made, by way of example, to the accompanying FIGURE, which is a cross-sectional view of part of a turbine stage of a gas turbine engine.

Gas flow through the engine is indicated by an arrow F, which is parallel to the engine axis (not shown).

The structure comprises a support ring 2 and a vane platform 4 which includes an outer wall 6 defining the gas flow path. In practice, the vane platform 4 is made up of a plurality of arcuate segments. Upstream of the support ring 2 and the vane platform 4, there is a high pressure turbine seal liner 8 supported by a cassette including a support 10. Again, the seal liner 8 and the support 10 are segmented.

The support ring 2 and the vane platform 4 are annular and centred on the engine axis. The vane platform 4 has an axial projection 12 which engages a circumferential slot 14 in the support ring 2 in order to support the vane platform within the engine while permitting relative axial movement between the vane platform 4 and the support ring 2. Separate means (not shown) is provided for axial location of the vane platform 4 within the engine.

The support ring 2 has a radially inwardly directed flange 16 which terminates short of the upstream end of the vane platform 4, leaving a gap 18. This gap 18 is sealed by a sealing ring 20. The sealing ring 20 has a cross-section, as seen in the FIGURE, which is generally L-shaped, comprising a first limb 24 which is directed generally radially of the engine axis, and a second limb 26 which is directed generally axially. The limbs are thus disposed at right angles to one another, providing an L-shaped cross-section.

The inwardly projecting flange 16 has, in its end face, a circumferential groove 28. The width of the groove 28 is slightly greater than the thickness of the radially extending first limb 24, so that the sealing ring 20 can move radially with respect to the support ring 2. The first limb 24 has a sealing face 27 which contacts a first abutment face 29 which forms the upstream face of the groove 28. This first abutment face 29 is centred upon the engine axis, and is oriented normal to the engine axis.

The second limb 26 has a sealing face 30 which contacts an outwardly facing second abutment surface 32 formed on the vane platform 4. The second abutment surface 32 is centred on the axis of the engine and extends parallel to that axis. The sealing ring 20 is a split ring, that is to say it is interrupted at one position around its circumference so that it can expand radially against the resilient action of the material of the sealing ring 20. The nominal diameter of the sealing ring 20 is smaller than that of the abutment surface 32, so that the resilient action of the sealing ring 20 biases it into contact with the second abutment surface 32. Consequently, the sealing ring 20 will follow any radial expansion and contraction of the vane platform 4 owing to temperature changes, any differential thermal expansion between the vane platform 4 and the support ring 2 being accommodated by movement of the first limb 24 in the groove 28. Similarly, any axial change in position between the vane platform 4 and the support ring 2 can be accommodated by sliding of the limb 26 along the second abutment surface 32.

The support ring 2 and the vane platform 4 define between them a chamber 34 which, in operation of the engine, is supplied with air at high pressure. The second limb 26 extends into the chamber from the first limb 24. As indicated by an arrow 36, this high pressure air acts on the second limb 26 so as to assist the resilient action of the spring 20 to increase the contact force between the sealing face 30 and the abutment surface 32.

The sealing ring 20 is provided with a plurality of bleed holes 38 which are distributed circumferentially around the sealing ring 20. The bleed holes are situated at the junction between the first limb 24 and the second limb 26, and are disposed obliquely with respect to the engine axis. In operation, air from the chamber 34 passes through the bleed holes 38 into the space 40 between the vane platform 4 and the HP turbine seal liner 8. This flow of air is 'funnelled' by the limbs 26,28 of the sealing ring 20, to generate a sealing force, indicated by arrow 41, which presses the limbs 26,28 against their respective abutment surfaces 27,32, improving the sealing efficiency of the sealing ring 20.

The seal liner 8 has a chordal rib 42 which engages the support ring 2 to prevent radially outward leakage of air from the space 40. Consequently, the relatively low pressure air in the space 40 emerges into the gas flow path of the engine to provide film cooling over the wall 6.

The sealing ring 20 must be made of a material capable of withstanding the temperatures to which it is exposed in operation of the engine, such as an aerospace alloy of high temperature capability.

Although the present invention has been described in the context of specific components of a gas turbine engine, it will be appreciated that a similar sealing arrangement may be used in other parts of a gas turbine engine, or indeed in other structures outside the gas turbine engine field. Also, although the sealing ring 20 is shown as an in-springing ring (ie it is pressed by its resilience and by the pressure in the chamber 34 into contact with the outwardly facing circumferential abutment surface 32), it will be appreciated that the sealing arrangement may be adapted so that the sealing face 30 contacts an inwardly facing abutment surface under a tendency of the sealing ring 20 to expand.

The invention claimed is:

1. A sealing arrangement between first and second annular components having a common axis, the arrangement comprising a sealing ring which, as viewed in cross-section, has a first limb which is slidable within a circumferential groove provided in the first annular component, and a second limb which is inclined to the first limb and which makes sealing contact with the second component, wherein the sealing ring is radially resilient and is provided with bleed holes which permit flow across the sealing ring, the second limb having a sealing face which is biased by the resilience of the sealing ring into contact with an abutment surface of the second component.

2. The sealing arrangement as claimed in claim 1, wherein the sealing ring is a split ring which is interrupted at one circumferential location.

3. The sealing arrangement as claimed in claim 1, wherein the first and second limbs are disposed perpendicular to each other, the first limb extending radially with respect to the axis and the second limb extending parallel to the axis.

4. The sealing arrangement as claimed in claim 1, wherein the sealing face is disposed on the side of the second limb opposite the first limb.

5. The sealing arrangement as claimed in claim 1, wherein the sealing face is biased radially inwardly into contact with the abutment face.

6. The sealing arrangement as claimed in claim 1, wherein the bleed holes are disposed at the junction between the first and second limbs.

7. The sealing arrangement as claimed in claim 1, wherein the first and second components are components of a turbine casing of a gas turbine engine.

8. The sealing arrangement as claimed in claim 7, wherein the sealing ring separates regions of high pressure and low pressure air.

9. The sealing arrangement as claimed in claim 8, wherein the second limb is exposed to the pressure in the high pressure region whereby the second limb is pressed towards the abutment surface.

10. The sealing arrangement as claimed in claim 8, wherein the bleed holes disposed at the junction between the first and second limbs, enabling flow from the high pressure region to the low pressure region.

11. A gas turbine engine provided with a sealing arrangement in accordance with claim 1.

* * * * *